United States Patent [19]

Bowditch

[11] 4,352,841

[45] Oct. 5, 1982

[54] SURFACE PRE-TREATMENT PRIOR TO UNDERWATER BONDING

[75] Inventor: Malcolm R. Bowditch, Broadstone, England

[73] Assignee: The Secretary of State for Energy in Her Britannic Majesty's Government of the United Kingdom of Great Britain and Northern Ireland, London, England

[21] Appl. No.: 284,318

[22] Filed: Jul. 17, 1981

[30] Foreign Application Priority Data

Jul. 30, 1980 [GB] United Kingdom ..... 8024896

[51] Int. Cl.[3] ..... B05D 3/00; B05D 3/12

[52] U.S. Cl. ..... 427/292; 156/281; 156/307.3; 156/330; 156/153; 427/327; 427/388.2; 427/410; 427/421

[58] Field of Search ..... 156/153, 281, 330, 389, 156/307.3; 427/327, 386, 388.2, 307, 409, 410, 421, 292, 156; 428/418; 29/DIG. 1, DIG. 7; 252/162, 153; 405/157, 216

[56] References Cited

U.S. PATENT DOCUMENTS

| | | | |
|---|---|---|---|
| 2,636,257 | 4/1953 | Ford | 29/195 |
| 2,669,546 | 2/1954 | Zussman et al. | 252/153 |
| 4,170,579 | 10/1979 | Bosso et al. | 428/418 |
| 4,273,598 | 6/1981 | Bowditch | 156/94 |

FOREIGN PATENT DOCUMENTS

| | | | |
|---|---|---|---|
| 1209402 | 1/1966 | Fed. Rep. of Germany | 252/162 |
| 1546098 | 10/1970 | Fed. Rep. of Germany . | |
| 1055872 | 2/1954 | France . | |
| 1327755 | 4/1963 | France . | |
| 7512036 | 4/1977 | Netherlands | 427/410 |
| 835072 | 5/1960 | United Kingdom | 427/327 |
| 2040732 | 9/1980 | United Kingdom . | |

OTHER PUBLICATIONS

Surface Preparation of Metals, Spencer, L. F., *Metal Finishing*, v. 58, No. 6, Jun. 1960, 53–58.

World Surface Coating Abstracts, vol. 52, Abstract #79/5428, No. 446, Aug. 1979, Yakovlev et al.

World Surface Coating Abstracts, vol. 51, Abstract #78/2598, No. 430, Apr. 1978, Drisko.

World Surface Coating Abstracts, vol. 51, Abstract #78/2603, No. 430, Apr. 1978, Grimes.

*Primary Examiner*—Edward C. Kimlin
*Assistant Examiner*—F. K. Wine
*Attorney, Agent, or Firm*—Pollock, VandeSande & Priddy

[57] ABSTRACT

The invention relates to a method of forming a metal-resin bond in the presence of environmental contamination of the metal surface by, for example, adsorbed water. The method consists of cleaning the metal surface and then coating it with a pre-treatment material adapted to displace the adsorbed contaminant and to be displaced in turn by the applied resin. The method is particularly relevant to the formation of steel/epoxy resin bonds underwater for the repair of submerged structures. The pre-treatment material may consist of a hydrocarbon solvent containing in solution a surfactant such as an ionic surfactant together with a viscous hydrocarbon such as petroleum jelly.

10 Claims, No Drawings

SURFACE PRE-TREATMENT PRIOR TO UNDERWATER BONDING

This invention relates to the formation of bonds between metal surfaces and adherent resin materials such as adhesives and paints.

The difficulties associated with obtaining a strong or successful bond between a resin and a metal are well-known in the arts of surface coatings and composite materials. The difficulties are associated generally with the need to obtain a contaminant-free metal surface on which to apply the resin material. In view of the high surface free energy of metal surfaces, a previously cleaned metal surface can experience unacceptable environmental contamination in the interval between cleaning and resin application. This is a particularly important problem in the case of bonding a resin adhesive to a metal such as steel in the presence of water, i.e. in an underwater environment or in generally wet conditions. Whereas it is well-known to clean the metal adequately prior to resin bonding, cleaned metal surfaces generally adsorb water very easily. Water molecules consequently saturate the metal surface, and are strongly adsorbed and difficult to remove.

An adsorbed contaminant on a metal surface generally reduces the strength of a resin bond to that surface. Moreover, the degree of reduction in strength will vary between bonds, since the degree of adsorption of the contaminant on the metal surface varies in an unpredictable way. The result is that resin-metal bonds exhibit unpredictable and degraded strength properties due to a contaminant. This is particularly true in the case of water-contaminated metal-resin bonds, such as bonds produced under water. When for example it is desired to form metal-resin bonds underwater for the purposes of repairing submerged structures, it is important that bonds can be made which are both strong and reliable, since the consequences of repair failure due to an unsuspected weak bond may be disastrous. The conventional underwater repair technique of cleaning the metal surface followed by applying resin does not provide acceptably strong reliable bonds.

It is an object of the present invention to provide an improved method of making metal/resin bonds. The present invention provides a method of bonding an adherent resin to a metal surface having an adsorbed contaminant including the steps of:

(a) cleaning the metal surface, (b) coating the cleaned metal surface with a pretreatment material, which pretreatment material is (i) adapted to displace the contaminant from the metal surface.

(ii) substantially chemically inert with respect to the metal, (iii) soluble in the resin, and (iv) displaceable from the metal surface by the resin, and (c) applying the resin to the coated metal surface The invention overcomes the problem of a contaminated metal surface by the use of a pretreatment material to displace the contaminant, the pretreatment material being in turn displaced from the metal surface by the resin. The invention offers the advantages that the contaminant is removed so that resin/metal bonds may be formed with enhanced strength and reliability.

The resin is preferably an epoxy resin adhesive.

The method of the invention is particularly appropriate for use in bonding resin adhesives to metal surfaces in environments in which the contaminant is water. The metal may for example be steel, aluminum bronze, aluminum alloy or stainless steel. In the case of a water contaminant the pretreatment material is preferably a solution of a surfactant in a hydrocarbon solvent immiscible with water. The solvent may conveniently be white spirit or a mixture of white spirit with solvent naphtha. Advantageously the pretreatment material may include a viscous additive to inhibit removal prior to resin bonding, such as for example petroleum jelly. The surfactant is preferably an ionic surfactant where the cation is a quaternary ammonium salt and the anion a fatty acid carboxylate group.

In a preferred embodiment, the method of the invention is employed to bond an adherent resin material to a steel surface in an underwater environment. Conveniently, the steel surface is cleaned, prior to coating with the pretreatment material, by compressed air to remove bulk water, and subsequently grit blasted to remove the outer steel surface. The pretreatment material is subsequently sprayed on to the cleaned steel surface; the material is preferentially (as compared to water) soluble in the resin, and preferably consists of a solution of a surfactant and petroleum jelly in either white spirit or white spirit and solvent naptha.

In order that the invention may be more fully appreciated, methods in accordance with the invention will now be described by way of example only.

For the purposes of displacing sea water from a steel surface, a range of pretreatment materials was prepared (hereinafter called "the formulated pretreatment material") having the following ranges of constituents:

(i) Petroleum Jelly 0.25 to 2 parts by weight (pbw)

(ii)

Either: (a) 100 pbw of White Spirit

Or: (b) 100 pbw of a White Spirit/Solvent Naphtha mixture containing between 50% and 80% by weight of White Spirit.

(iii) Surfactant: 1 to 2 pbw of Duomeen TDO (trade name, AKZO Chemical UK Ltd, formulation N-tallow-1,3-diaminopropane dioleate, or $[RNH_2(CH_2)_3NH_3]^2+2C_{17}H_{33}COO-$, where R is a alkyl group derived from tallow. This material has a quaternary ammonium salt cation and a fatty acid carboxylate group anion.

Two solid right circular steel cylinders of 35 mm diameter, suitable for attachment to a standard tensometer, were prepared for underwater bonding end to end (tensile butt joint) as follows. The end surfaces were cleaned under seawater by a compressed air blast from a pressure hose having a cone shaped outlet, the outlet being positioned 2 to 3 mm from the steel base of each cylinder. The airstream was employed to displace bulk water leaving a wet steel surface. Abrasive grit such as sharp sand was then introduced into the airstream to produce a high velocity abrasive jet eroding the steel surface and reducing adsorbed water. The formulated pretreatment material was then introduced into the airstream to form an atomized spray over the steel surface. The spray displaced residual water and formed a water repellent film over the surface of the steel. After the bases of both steel cylinders were thus treated, their treated surfaces were coated with epoxy resin adhesive of the kind described in Applicant's Units Kingdom patent applications Nos. 2419/77 and 47114/77 and corresponding foreign applications. The adhesive formulation designated UW45 is repeated here for convenience:

| UW45 Epoxy Resin Adhesive | | | |
|---|---|---|---|
| Part | Constituent | Function or Description | Parts by Weights |
| Part A | Araldite GY250 | Resin-diglycidyl ether of bisphenol 'A' (Ciba-Geigy Ltd) | 100 |
| | Union Carbide A187 | Liquid, epoxide functional silane | 15 |
| | Barytes | Filler | 75 |
| | Aerosil 200 | Finely divided silica filler | 4.5 |
| Part B | Araldite HY850 | Liquidisable diaminodiphenylmethane (Ciba-Geigy Ltd) | 64 |
| | Orgol Tar | Refined coal tar plasticiser | 40 |
| | Barytes | Filler | 86 |
| | Aerosil 200 | finely divided silica filler | 3.5 |

Parts A and B are used in equal quantities by weight.

The steel cylinders were bonded together at their resin-coated end surfaces forming a tensile butt joint. This was carried out under sea water, with resin curing at an ambient temperature of about 19° C. The strength of the joint was subsequently tested in a tensometer.

This procedure was carried out for a total of 72 test bonds between pairs of steel cylinders. The failure stress $\bar{\sigma}$ of the bond in each case was determined using the tensometer, the mean failure stress $\sigma$ with its standard deviation being:

$$\bar{\sigma}=17.5\pm1.1 \text{ MPa (Megapascals, or } 10^6 \text{ Newtons/Metre}^2)$$

For comparison purposes, the steel/resin/steel bond failure stress obtained without using the formulated pretreatment material coating, but otherwise identical procedure including surface cleaning by grit blasting only, was:

$$\bar{\sigma}=5.5\pm1.4 \text{ MPa}$$

This value was obtained from a total of 90 test joints. The figure of 5.5±1.4 MPa was obtained in a manner which would be considered in the art as careful and technically sound resin bonding practice for the purpose of carrying out underwater repairs.

It is evident from the above figures that the method of the invention, when used under sea water to make a steel/resin/bond, improves the failure strength by better than a factor of three as compared to conventional techniques. Moreover, the standard deviation is improved from 25% of the mean to 6%, a factor of four. Accordingly, considerably stronger joints are provided with considerably greater reliability. In the repair of underwater steel structures such as partially ocean submerged oil platforms, the strength of a repair to a damaged or corroded structural member is extremely important. Furthermore, it is highly necessary to achieve a given strength reliably, since the consequences of unreliable repairs may be disastrous.

The method of the invention was also employed for the purposes of resin bonding to aluminum alloy, aluminum bronze and stainless steel. In each of these three cases, tests were carried out under sea water using the formulated pretreatment material, UW45 resin, grit blasting, bonding and test procedures as hereinbefore set out for steel. For comparison purposes, similar bonds were made conventionally in air using surfaces cleaned by careful blasting with clean grit, but without using a pretreatment material coating. The results are set out in Table 1.

| | Tensile Failure Stress | |
|---|---|---|
| Material | Pretreated Surfaces Bonded Under Water | Untreated Surfaces Bonded in Air (Conventional) |
| Aluminum Bronze | 10.5 ± 0.5 | 10.3 ±1.0 |
| Aluminum Alloy | 8.0 ± 0.33 | 8.6 ± 0.5 |
| Stainless Steel | 19.1 ± 0.4 | 26.7 ± 1.2 |

From Table 1 it can be seen that the invention provides aluminum bronze or alloy bonds made under sea water with resin adhesive which are as strong as those produced by conventional methods in air. With stainless steel, the invention produces an underwater bond strength of about three quarters that of the conventionally-produced value in air. Furthermore, in all cases the standard deviation is reduced by between ⅓ and ⅔ indicating increased reliability. Experience with metal/resin bonds indicates that underwater bonds may generally be expected to be in the region of one third as strong as and less reliable than similar bonds made in air. Accordingly, these results indicate improved strength and reliability for metal/resin bonds made in accordance with the invention as compared to those produced by conventional techniques.

The formulated pretreatment material hereinbefore set out has been produced specifically for the purposes of removing adsorbed water from metal surfaces while remaining soluble in the resin to be bonded. The hydrocarbon solvent (White spirit or White spirit/solvent naphtha mixture) serves to preferentially contaminate the metal surface as compared to water, which is therefore displaced. The surfactant is included to displace water thus allowing the solvent to wet the metal surface and the petroleum jelly is added to increase viscosity so that the pretreatment coating is mechanically more difficult to remove by the surrounding water environment. The formulated pretreatment material is compatible (chemically inert) with metals, is soluble in or displaceable by the resin employed and is immiscible with water. Success has also been employed with commercially available water displacing liquids such as Ardrox 3961 and Ardrox 3964 (Trade names, Ardrox Ltd). However, commercial fluids may contain corrosion inhibitors and/or lubricants which may not be chemically compatible with a resin/metal bond. It will be apparent to workers skilled in the chemical art that for a given combination of resin, metal and contaminant, a pretreatment material should be chosen for compatibility with the metal, ability to displace the contaminant and compatibility with the resin.

It is important that the method of the invention be carried out using the correct sequence of steps, i.e. metal surface cleaning, pretreatment and resin application. Pretreatment should follow as soon as possible after cleaning, and under water may advantageously be performed with the aid of a cone-shaped air pressure outlet having two discrete operating zones, a forward zone and a rear zone. Both zones are connected to the pressurized air supply. The forward zone is arranged to supply abrasive grit and the rear zone atomized pretreatment material, carried in the respective airstream in either case. The outlet cone may be swept over the metal surface to provide a continuous treatment in which each surface portion is first cleaned and then pretreated. Flow-rates, outlet distance from metal surface, and pretreatment constituents may be optimized for a particular application by performing simple tests in individual circumstances.

Once a metal surface has been pretreated, as is well-known in the art it is desirable to apply the resin as soon as possible, ideally within 2 hours for epoxy resins. However, it has been found that steel surfaces pretreated in accordance with the invention have remained wettable by epoxy resins underwater for up to 72 hours, with variation according to ambient conditions, water currents, and water-borne contamination. Accordingly it is believed that pretreatment in accordance with the invention renders metal/resin bonds less sensitive to degradation by divergence from ideal bonding conditions.

I claim:

1. A method of bonding an adherent resin to a metal surface having an adsorbed water contaminant including the steps of a. cleaning the metal surface b. removing the contaminant from said surface by coating the cleaned metal surface with a pretreatment material comprising an organic solvent and a surfactant, which pretreatment material is i. adapted to displace the absorbed contaminant from the metal surface ii. substantially chemically inert with respect to the metal iii. soluble in the resin, and iv. displaceable from the metal surface by the resin, and c. with said surface still coated with said pretreatment material, applying the adherent resin to the coated metal surface to cause the resin to remove said pretreatment material from said metal surface by solution of the pretreatment material into the resin while said resin bonds to said metal surface.

2. A method according to claim 1 wherein the resin is an epoxy resin adhesive.

3. A method according to claim 1 wherein the metal is selected from the group comprising steel, stainless steel, aluminum alloy and aluminum bronze.

4. A method according to claim 3 wherein the pretreatment material consists at least partially of a surfactant and a viscous hydrocarbon material dissolved in a hydrocarbon solvent.

5. A method according to claim 4 wherein the solvent is either white spirit or a mixture of white spirit and solvent naptha containing between 50% an d80% white spirit.

6. A method according to claim 4 or 5 wherein the surfactant is an ionic surfactant.

7. A method according to claim 6 wherein the surfactant comprises a quarternary ammonium salt cation and a fatty acid carboxylate group anion.

8. A method according to claim 7 wherein the surfactant is N-tallow 1, 3-diaminopropane dioleate.

9. A method according to claim 8 wherein the pretreatment material consists substantially of:

a. 1 to 2 parts by weight of the surfactant b. 0.25 to 2 parts by weight of petroleum jelly, and c. 100 parts by weight of hydrocarbon solvent.

10. A method according to claim 1 wherein the metal is cleaned by grit blasting and coated with pretreatment material with the aid of a pressurized air supply connected to an outlet having a grit-dispensing forward compartment and a pretreatment material-dispensing rear compartment.

* * * * *